US005665032A

United States Patent [19]

Chen

[11] Patent Number: 5,665,032

[45] Date of Patent: Sep. 9, 1997

[54] MANUAL TREADMILL EXERCISER WITH AIR BLOWING RETARDANT ASSEMBLY

[75] Inventor: David Chen, Taichung, Taiwan

[73] Assignee: Stamina Products, Inc., Springfield, Mo.

[21] Appl. No.: 524,875

[22] Filed: Sep. 7, 1995

[51] Int. Cl.[6] ..... A63B 22/02

[52] U.S. Cl. ..... 482/54; 482/111

[58] Field of Search ..... 482/54, 111

[56] References Cited

U.S. PATENT DOCUMENTS

| | | | |
|---|---|---|---|
| 931,394 | 8/1909 | Day . | |
| 3,659,845 | 5/1972 | Quinton . | |
| 3,809,003 | 5/1974 | Foldvari | 482/54 |
| 4,151,988 | 5/1979 | Nabinger | 482/54 |
| 5,102,380 | 4/1992 | Jacobson et al. | 482/54 |
| 5,437,588 | 8/1995 | Abboudi et al. | 482/54 |

FOREIGN PATENT DOCUMENTS

| | | |
|---|---|---|
| 1 057 928 | 5/1959 | Germany . |

*Primary Examiner*—Lynne A. Reichard

*Attorney, Agent, or Firm*—Cushman Darby & Cushman IP Group of Pillsbury Madison & Sutro LLP

[57] ABSTRACT

A motorless manually operated treadmill exerciser including a frame structure having a plurality of transverse rollers at a bottom side thereof and a track mounted around the transverse rollers for movement by a user walking or running thereon. A wind resistance retarding assembly is mounted on the frame structure in front of the track which includes a series of fan blades rotatably driven by the rollers through a pair of spaced belt and pulley assemblies. The wind resistance produced by the turning fan blades is directed at the user and serves to retard the movement of the track when the user desires to slow the pace or disembark.

2 Claims, 2 Drawing Sheets

MANUAL TREADMILL EXERCISER WITH AIR BLOWING RETARDANT ASSEMBLY

BACKGROUND OF THE INVENTION

The present invention relates to exercisers, and relates more particularly a treadmill of the motorless manually operated type.

Various treadmill exercisers have been disclosed for walking or running exercises, and have appeared on the market. These treadmill exercisers commonly comprise a frame structure supporting a treadmill assembly which includes a plurality of transverse rollers, and a track mounted around the transverse rollers in a sloping direction. When the player hikes or runs on the track, the track is moved, and the rollers are turned by the track. Because the rollers are rotated when the track is moved by the legs of the player, little resistance is produced and transmitted to the legs of the player. However, when one hikes or runs in the open field, a wind resistance will be produced and acted against the body, and therefore one is forced to consume much oxygen. Therefore, conventional treadmill exercisers cannot achieve the desired exercising effect. Furthermore, because the track is disposed in a sloping position, an inertial force will be produced from the track when the track is moved by the legs to turn the rollers. This inertia force tends to cause the player to fall when he desires to slow down the pace or disembark.

Power operated treadmill exercisers obviate this tendency with the drag that the motor hook up has on the treadmill. That is, the motor and its connection to the treadmill assembly serve to effectively retard the track movement in response to the user controlling the motor so as to permit the user to slow down or disembark without falling. Motorless manually operated treadmill exercisers do not have motor control for the speed of the track which the user can match. Instead, the speed of the track is created by the user and without a retardant such as a motor hook up, slowing down the treadmill movement becomes more of a problem to the user. This is particularly true where the treadmill assembly includes one or more fly wheels to stabilize treadmill movement.

There exists a need to provide a manually operated treadmill exerciser with a retarding assembly which can also fulfill the need to simulate wind impinging on the user.

BRIEF DESCRIPTION OF THE INVENTION

An object of the present invention is to fulfill the need expressed above. In accordance with the principles of the present invention, this objective is achieved by providing a motorless manually operated treadmill exerciser comprising a frame structure, a treadmill assembly and retardant assembly. The frame structure is constructed and arranged to be mounted in an operative position on a solid horizontal support surface. The frame structure includes a pair of elongated transversely spaced generally parallel frame members positioned to support the treadmill assembly above the horizontal support surface when the frame structure is in the operative position. The treadmill assembly includes a trailing roller mounted between trailing ends of the spaced frame members for rotation about a transversely extending trailing roller axis, and a leading roller mounted between forward end portions of the spaced frame members for rotation about a leading roller axis parallel to the trailing roller axis. A flexible endless track is trained about the leading and trailing rollers so as to define an upper flight and a lower flight. A support structure extends between the pair of frame members between the leading and trailing rollers and between the upper and lower flights of the endless track. The support structure is constructed and arranged to support the movement of the upper flight of the endless track in response to a forwardly facing user manually walking or running on an upper surface of the upper flight of the endless track. The retardant assembly is constructed and arranged to establish a retardant to the continued movement of the endless track when the user desires to slow the walking or running speed or disembark.

The retardant assembly comprises a shaft mounted between the forward end portions of the spaced frame members in forwardly spaced relation to the leading roller for rotation about an axis parallel with the leading roller axis. A series of annularly spaced fan blades are fixed to the shaft. The transverse extent of the series of fan blades is substantially coextensive with the transverse extent of the endless track. A motion transmitting mechanism is operatively connected between the leading roller and the shaft. The motion transmitting mechanism is constructed and arranged to rotate the shaft in response to the rotation of the leading roller at an increased speed proportional to the speed at which the leading roller is rotated due to the forwardly facing user walking or running on the upper surface of the upper flight of the endless track. A guard is fixed to the spaced frame members and extends transversely over the series of fan blades. The guard has a series of openings therein for the passage of air therethrough in a direction to impinge upon a forwardly facing user walking or running On the upper surface of the upper flight of the endless track. The series of fan blades are spaced upwardly from the horizontal support surface when the frame structure is in the operative position with the space below the series of fan blades being open to provide an air inlet for the series of fan blades.

The series of fan blades and the guard and the openings therein are constructed and arranged to enable the rotation of the series of fan blades with the shaft, due to a forwardly facing user walking or running on the upper surface of the upper flight of the endless track, to create a flow of air entering through the open space below the series of fan blades to pass upwardly through the openings in the guard to impinge on the forwardly facing user with a velocity which is determined by the rate at which the user is walking or running on the upper surface of the upper flight of the endless track. The shaft and series of fan blades thereon being devoid of any source of rotative power connected therewith and being rotated to create the flow of air solely by the manual effort of the forwardly facing user walking or running on the upper surface of the upper flight of this endless track. The shaft and series of fan blades thereon are constructed and arranged to enable the flow of air to establish a retardant to the continued movement of the endless track when the user desires to slow the walking or running speed or disembark.

DETAILED DESCRIPTION OF THE PREFERRED EMBODIMENT

Figure 1:
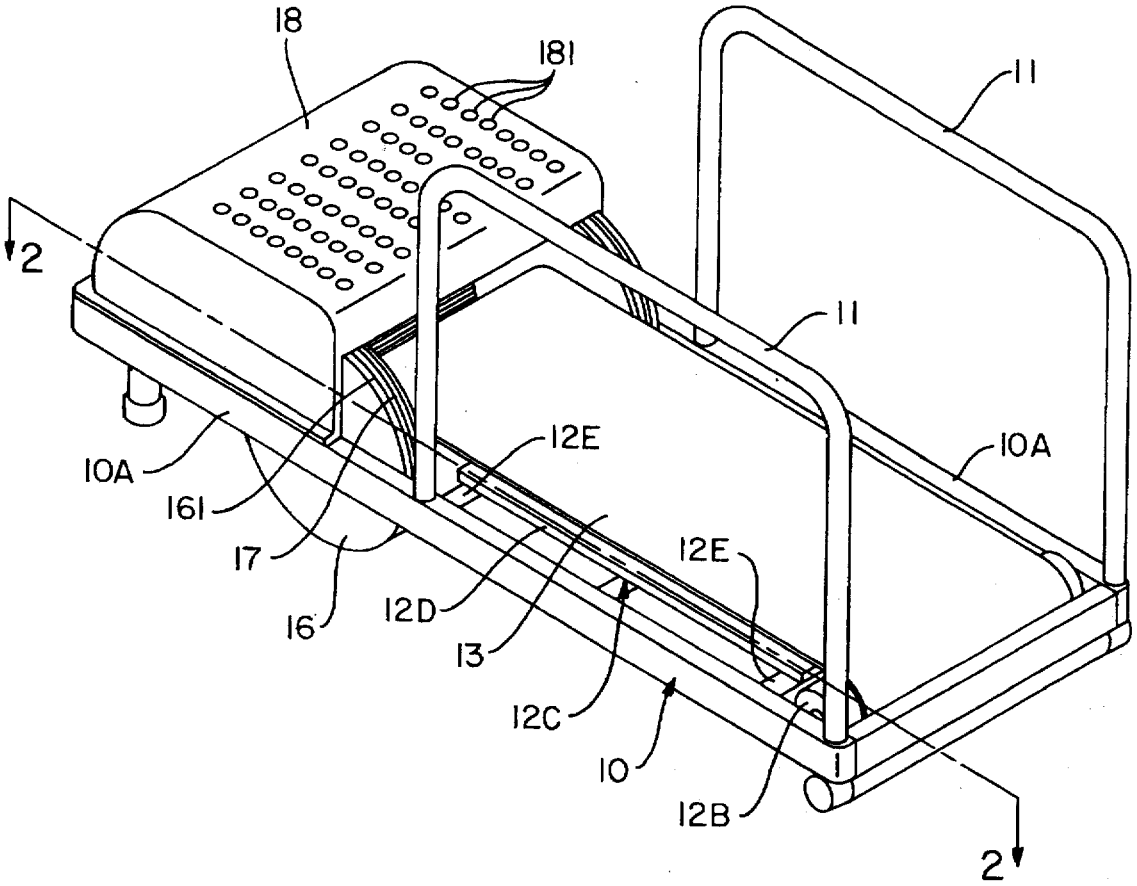
FIG. 1 is a perspective view of a manually operated treadmill exerciser embodying the principles of the present invention.
Figure 2:
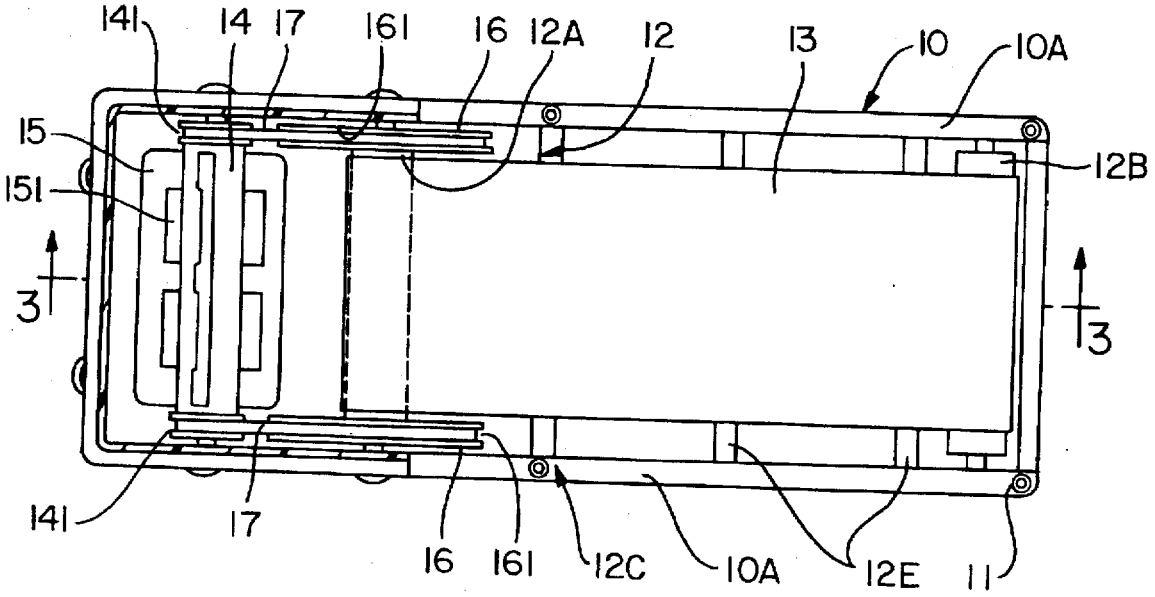
FIG. 2 is a sectional view taken along line 2—2 of FIG. 1.
Figure 3:
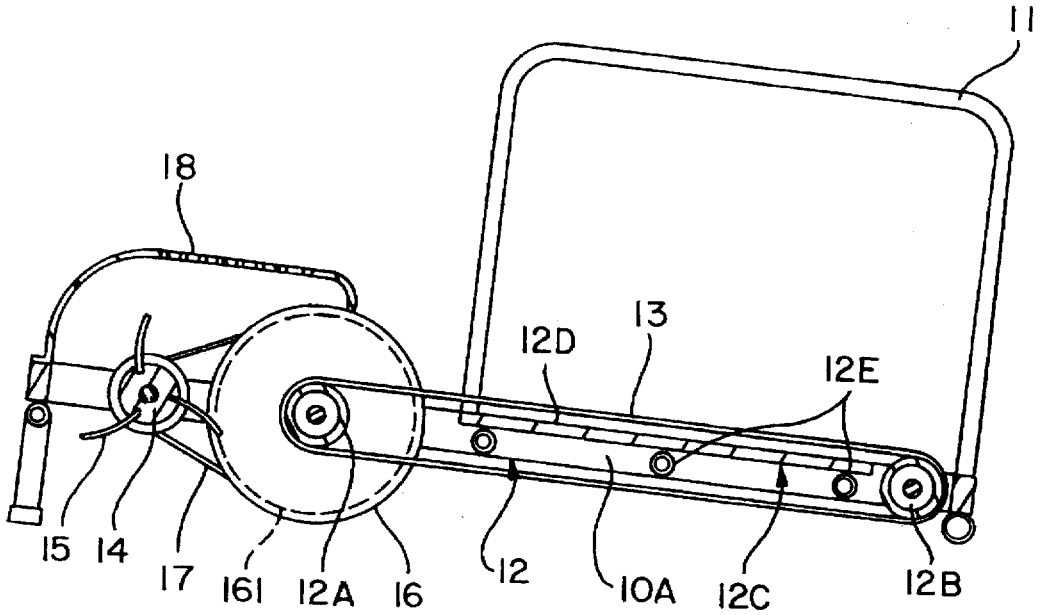
FIG. 3 is a sectional view taken along line 2–3 of FIG. 2.

Referring to FIGS. 1, 2 and 3, there is shown therein an exerciser, embodying the principles of the present invention which includes a frame structure, generally indicated at 10. As shown, the frame structure 10 is in the form of a rectangular rim including a pair of elongated transversely spaced parallel side frame members 10A.

Two transversely spaced handrails 11 extend upwardly from the side frame members 10A. A treadmill assembly, generally indicated at 12, is supported between the side frame members 10A. As shown, the treadmill assembly 12 includes a front or leading guide roller 12A and a rear or trailing guide roller 12B transversely disposed respectively at the front and rear ends of the frame members 10A. Extending transversely between the frame member 10A in parallel relation between the front guide roller 12A and the rear guide roller 12B is a track supporting structure, generally indicated at 12C. As best shown in FIG. 3, the track supporting structure 12C includes an upper platform 12D supported by a plurality of longitudinally space transversely extending support tubes 12E. A flexible endless track 13 is trained about the front guide roller 12A and the rear guide roller 12B so as to define a lower flight and an upper flight disposed in supported contact with the track supporting structure 12C.

A shaft 14 is rotatably mounted on the frame structure 10 between the side frame members 10 in forwardly spaced relation in front of the front guide roller 12A. The shaft 14 has two belt mounting grooves 141 therein disposed around the periphery at opposite ends thereof. A series of annularly spaced fan blades 15 are fixed to the shaft 10 around the periphery between the belt mounting grooves 141. Each fan blade 15 has a plurality of slots 151 for reducing noises upon the rotation of the shaft 14. As shown in FIG. 2 of the drawings, the transverse extent of the series of fan blades 15 is substantially coextensive with the transverse extent of the endless track 13.

Two fly wheels 16 are fixedly mounted with respect to the front guide roller 12A at opposite ends thereof. Each fly wheel 16 has a belt mounting groove 161 around the periphery. Two transmission belts 17 are respectively mounted on the belt mounting grooves 141 of the shaft 14 and the belt mounting grooves 161 of the fly wheel 16. The belts 17 and the grooved members about which they are trained constitute a belt and pulley motion transmitting mechanism which serves to rotate the shaft 14 and series of fan blades 15 in response to the rotation of the front guide roller 12A at an increased speed which is proportional to the speed of the roller 12A. When the track 13 is moved by a forwardly facing user walking or running on the upper surface of the upper flight of the track 13, the fly wheels 16 are turned to rotate the shaft 14 through the movement of the transmission belts 17. When the shaft 14 is rotated, the fan blades 15 are moved to cause a flow of air. Therefore, the shaft 14 and the fan blades 15 form a wind wheel, which creates a wind resistance tending to retard the movement of the track 13. When the treadmill assembly is operated to move the track 13, the guide rollers 12A and 12B are rotated by the track 13, and therefore the inertia force from the track 13 and the rollers 12A and 12B is reduced by the wind resistance.

Referring to FIGS. 1 and 3 again, a guard 18 is mounted on the frame structure 10 between side frame members 10A at the front ends thereof and extends transversely over the wind wheel (the shaft 14 and the blades 15). The guard 18 has a plurality of openings or vent holes 181 for directing air therethrough to impinge upon a forwardly facing user walking or running on the upper surface of the upper flight of the track 13.

Referring to FIGS. 1, 2 and 3 again, when in use, the user steps on the treadmill assembly facing forward with the hands rested on the handrails 11. As shown, the upper flight of the track 13 slopes in an upwardly and forwardly direction facilitating the movement of the track 13 when the user walks or runs on it. When the track 13 is moved, the rollers 12A and 12B are rotated, and at the same time the fly wheels 16 are turned to rotate the shaft 14 through the transmission belts 17, causing the series of fan blades 15 to create a flow of air from the open area beneath the series of fan blades 15 and outwardly through the openings or vent holes 181 of the guard 18 to impinge upon the user. In this way the shaft 14 and series of fan blades 15 constitute a retarding assembly operable to produce a wind resistance which serves to retard the movement of the track 13 when the user desires to slow the pace or disembark.

I claim:

1. A motorless manually operated treadmill exerciser comprising a frame structure constructed and arranged to be mounted in an operative position on a solid horizontal support surface, said frame structure including a pair of elongated transversely spaced generally parallel frame members positioned to support a treadmill assembly above the horizontal support surface when said frame structure is in said operative position, said treadmill assembly including a trailing roller mounted between trailing ends of said spaced frame members for rotation about a transversely extending trailing roller axis, a leading roller mounted between forward end portions of said spaced frame members for rotation about a leading roller axis parallel to said trailing roller axis, a flexible endless track trained about said leading and trailing rollers so as to define an upper flight and a lower flight, and support structure extending between said pair of frame members between said leading and trailing rollers and between the upper and lower flights of said endless track, said support structure being constructed and arranged to support the movement of the upper flight of said endless track in response to a forwardly facing user manually walking or running on an upper surface of the upper flight of the endless track, and a retardant assembly constructed and arranged to establish a retardant to the continued movement of the endless track when the user desires to slow the walking or running speed or disembark, said retardant assembly comprising a shaft mounted between the forward end portions of said spaced frame members in forwardly spaced relation to said leading roller for rotation about an axis parallel with the leading roller axis, a series of annularly spaced fan blades fixed to said shaft, the transverse extent of said series of fan blades being substantially coextensive with the transverse extent of said endless track, a motion transmitting mechanism operatively connected between said leading roller and said shaft, said motion transmitting mechanism being constructed and arranged to rotate said shaft in response to the rotation of said leading roller at an increased speed proportional to the speed at which the leading roller is rotated due to the forwardly facing user walking or running on the upper surface of the upper flight of said endless track, and a guard fixed to said spaced frame members and extending transversely over said series of fan blades, said guard having a series of openings therein for the passage of air therethrough in a direction to impinge upon a forwardly facing user walking or running on the upper surface of the upper flight of the endless track, said series of fan blades being spaced upwardly from the horizontal support surface when said frame structure is in said operative position with the space below said series of fan blades being open to provide an air inlet for said series of fan blades, said series of fan blades and said guard and the openings therein being constructed and arranged to enable the rotation of said series of fan blades with said shaft due to a forwardly facing user walking or running on the upper surface of the upper flight of said endless track to create a flow of air entering through the open space below said series of fan blades to pass upwardly through the openings in said guard to impinge on the forwardly facing user with a velocity which is determined by the rate at which the user is walking or running on the upper surface of the upper flight of the endless track, said shaft and series of fan blades thereon being devoid of any source of rotative power connected therewith and being rotated to create said flow of air solely by the manual effort of the forwardly facing user walking or running on the upper surface of the upper flight of said endless track, said shaft and series of fan blades thereon being constructed and arranged to enable said flow of air to establish a retardant to the continued movement of the endless track when the user desires to slow the walking or running speed or disembark.

2. A motorless manually operated treadmill exerciser as defined in claim 1 wherein said motion transmitting assembly comprises a pair of transversely spaced relatively large pulleys fixed with respect to said leading roller at opposite ends thereof, a pair of transversely spaced relatively small pulleys fixed with respect to said shaft at opposite ends of said series of fan blades and a belt trained about each associated set of relatively large and small pulleys.

* * * * *